US009956682B1

(12) United States Patent
Simmons et al.

(10) Patent No.: US 9,956,682 B1
(45) **Date of Patent: *May 1, 2018**

(54) TOOL BOX WITH A REINFORCED DOOR

(75) Inventors: Jason Matthew Simmons, Sparta, TN (US); John Lawrence Bella, Cookeville, TN (US)

(73) Assignee: PHOENIX U.S.A., INC., Cookeville, TN (US)

( * ) Notice: Subject to any disclaimer, the term of this patent is extended or adjusted under 35 U.S.C. 154(b) by 675 days.

This patent is subject to a terminal disclaimer.

(21) Appl. No.: 13/556,851

(22) Filed: Jul. 24, 2012

Related U.S. Application Data

(62) Division of application No. 12/690,628, filed on Jan. 20, 2010, now Pat. No. 8,251,250.

(60) Provisional application No. 61/210,732, filed on Mar. 23, 2009.

(51) Int. Cl.
*E05D 13/00* (2006.01)
*B25H 3/02* (2006.01)
*E05D 7/00* (2006.01)

(52) U.S. Cl.
CPC ..... *B25H 3/02* (2013.01); *E05D 7/009* (2013.01); *E05Y 2900/132* (2013.01)

(58) Field of Classification Search
CPC ..... B25H 3/02; E05D 7/009; E05B 65/025; E05B 5/006
USPC ..... 52/65, 69, 71, 784.12, 784.13; 220/1.5–1.6, 4.22, 244, 254.3, 254.5, 220/254.6, 259.1–259.2, 275, 600, 603, 220/625, 640–642, 651–652, 655–657, 220/729, 780, 782, 784, 794, 796, 799, 220/810, 827–832, 841, 845, 848; 312/109, 110, 249.7, 265.5, 270.2, 294, 312/313–316, 319.1–319.4, 321.5, 312/325–329
See application file for complete search history.

(56) References Cited

U.S. PATENT DOCUMENTS

| | | | | | |
|---|---|---|---|---|---|
| 814,563 | A | * | 3/1906 | Pond | 220/476 |
| 1,715,538 | A | * | 6/1929 | Dean et al. | 220/3.8 |
| 1,918,195 | A | * | 7/1933 | Robertson | 312/268 |
| 2,300,405 | A | * | 11/1942 | Cook | 126/275 R |
| 2,338,477 | A | * | 1/1944 | Wolters et al. | 220/812 |
| 3,282,462 | A | * | 11/1966 | Box | 220/826 |
| 3,410,109 | A | * | 11/1968 | Maryland | 62/457.9 |
| 3,567,062 | A | * | 3/1971 | Reed et al. | 220/832 |
| 3,623,785 | A | * | 11/1971 | Williams | 312/267 |
| 3,640,423 | A | * | 2/1972 | Parker et al. | 220/324 |
| 3,665,728 | A | * | 5/1972 | Stoller | 62/320 |
| 3,672,529 | A | * | 6/1972 | Feddersen et al. | 220/1.5 |

(Continued)

*Primary Examiner* — Steven A. Reynolds
*Assistant Examiner* — James Way
(74) *Attorney, Agent, or Firm* — Bradley Arant Boult Cummings LLP; Phillip Walker

(57) ABSTRACT

A tool box having a reinforced door that withstands prying and resists flexing during use. The door includes a reinforced region including a first flange, a second flange and a third flange extending from the first edge of the door. At least one additional flap extends from an edge of the door adjacent to the reinforced region and is welded to the reinforced region to provide additional strength. In another embodiment, a second and a third additional flap is included on the door, and each additional flap may be welded to an adjacent flap or welded to the reinforced region. Multiple reinforced regions, each including at least one flange, may also extend from the door body to provide increased strength.

21 Claims, 5 Drawing Sheets

(56) References Cited

U.S. PATENT DOCUMENTS

| | | | | | |
|---|---|---|---|---|---|
| 3,680,475 | A * | 8/1972 | Gladwin | 100/100 |
| 3,706,392 | A * | 12/1972 | Sprick et al. | 220/812 |
| 3,786,613 | A * | 1/1974 | Shepheard | 52/784.13 |
| 3,837,722 | A * | 9/1974 | Ceccarelli | 312/276 |
| 3,850,336 | A * | 11/1974 | Acosta | 220/830 |
| 3,940,009 | A * | 2/1976 | Szeles | 220/564 |
| 3,945,530 | A * | 3/1976 | Bozich | 220/3.8 |
| 4,057,170 | A * | 11/1977 | Dougherty | 220/323 |
| 4,223,482 | A * | 9/1980 | Barroero et al. | 49/386 |
| 4,456,141 | A * | 6/1984 | Pamment | 220/254.5 |
| 4,522,326 | A * | 6/1985 | Tuohy, III | 224/310 |
| 4,543,798 | A * | 10/1985 | Page | 62/239 |
| 4,548,330 | A * | 10/1985 | Hewitt et al. | 220/210 |
| 4,618,067 | A * | 10/1986 | Cohn et al. | 220/1.5 |
| 4,635,992 | A * | 1/1987 | Hamilton et al. | 296/37.6 |
| 4,707,038 | A * | 11/1987 | Voegeli | 312/265.5 |
| 4,793,284 | A | 12/1988 | Davis | |
| 4,821,902 | A * | 4/1989 | May | 220/812 |
| 4,914,340 | A * | 4/1990 | Fox | 312/211 |
| 5,056,878 | A * | 10/1991 | Givens | 312/351.3 |
| 5,158,198 | A * | 10/1992 | Melideo | 220/263 |
| 5,215,366 | A * | 6/1993 | Givens | 312/351.3 |
| 5,251,775 | A * | 10/1993 | Kruzick et al. | 220/812 |
| 5,464,115 | A * | 11/1995 | Tisbo et al. | 220/324 |
| 5,476,316 | A * | 12/1995 | Batroney et al. | 312/287 |
| 5,533,643 | A * | 7/1996 | Kruzick | 220/812 |
| 5,755,351 | A * | 5/1998 | Kruzick | 220/812 |
| 5,802,801 | A * | 9/1998 | Hohns et al. | 52/792.1 |
| 6,101,773 | A * | 8/2000 | Chau et al. | 52/220.7 |
| 6,203,086 | B1 * | 3/2001 | Dirks et al. | 296/37.6 |
| 6,364,154 | B2 * | 4/2002 | Kruzick et al. | 220/813 |
| 6,396,019 | B1 | 5/2002 | Williams | |
| 6,409,064 | B1 * | 6/2002 | Bayley | 224/404 |
| 6,641,013 | B2 | 11/2003 | Dise | |
| 6,732,883 | B2 | 5/2004 | Fowler et al. | |
| 7,198,166 | B2 * | 4/2007 | Sholinder | 220/4.33 |
| 7,237,689 | B2 * | 7/2007 | Maggio et al. | 220/675 |
| 7,360,817 | B2 * | 4/2008 | Schwalie et al. | 296/37.6 |
| 7,540,381 | B2 | 6/2009 | Blasco | |
| 7,789,256 | B2 * | 9/2010 | Petzitillo et al. | 220/1.5 |
| 7,866,773 | B2 * | 1/2011 | Leimkuehler et al. | 312/405 |
| 7,886,500 | B2 * | 2/2011 | Leimkuehler et al. | 52/784.1 |
| 7,900,582 | B2 * | 3/2011 | Yu | 119/265 |
| 7,972,027 | B1 | 7/2011 | Hatfield | |
| 8,056,759 | B2 | 11/2011 | Spence | |
| 8,112,943 | B2 | 2/2012 | Medley et al. | |
| 8,251,250 | B1 * | 8/2012 | Simmons et al. | 220/810 |
| 2001/0032848 | A1 * | 10/2001 | Jones et al. | 220/200 |
| 2002/0088812 | A1 | 7/2002 | Petzitillo et al. | |
| 2003/0173878 | A1 * | 9/2003 | Youngs et al. | 312/257.1 |
| 2003/0189074 | A1 * | 10/2003 | Dise | 224/404 |
| 2003/0192900 | A1 | 10/2003 | Petzitillo et al. | |
| 2004/0188433 | A1 | 9/2004 | Morales et al. | |
| 2005/0017001 | A1 | 1/2005 | Katz | |
| 2005/0178765 | A1 * | 8/2005 | Howes | 220/210 |
| 2006/0102575 | A1 | 5/2006 | Mattlin et al. | |
| 2006/0265960 | A1 * | 11/2006 | Leimkuehler et al. | 49/501 |
| 2007/0151971 | A1 * | 7/2007 | Petzitillo et al. | 220/1.5 |
| 2007/0210681 | A1 * | 9/2007 | Adducci et al. | 312/7.2 |
| 2008/0017638 | A1 | 1/2008 | Bradford | |
| 2008/0017649 | A1 | 1/2008 | Elgan et al. | |
| 2008/0211363 | A1 * | 9/2008 | Carter et al. | 312/216 |
| 2009/0107411 | A1 * | 4/2009 | Yu | 119/265 |
| 2009/0134755 | A1 * | 5/2009 | Lakoduk et al. | 312/326 |
| 2010/0288786 | A1 | 11/2010 | Spence | |

* cited by examiner

TOOL BOX WITH A REINFORCED DOOR

CROSS-REFERENCES TO RELATED APPLICATIONS

This application is a Divisional application which claims the benefit of co-pending U.S. patent application Ser. No. 12/690,628 filed Jan. 20, 2010 entitled "Tool Box with a Reinforced Door", which is a Non-Provisional Utility application claiming the benefit of U.S. Provisional Patent Application Ser. No. 61/210,732 filed Mar. 23, 2009 entitled "Rolled Toolbox Door", both of which are hereby incorporated by reference in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to an enclosure for storing items. More particularly, the present invention relates to a metal box for storing tools or other hardware, especially a rectangular sheet metal box with a hinged door having a reinforced region for improving the structural rigidity of the door.

Tools, hardware and other items are commonly stored in metal enclosures, generically referred to as tool boxes, for safe-keeping during periods of non-use. Tool boxes of this type are frequently placed in garages, mounted on vehicles, or kept at outdoor work sites. In these situations, public accessibility increases the likelihood of attempts by unauthorized individuals to gain access to the items stored in the tool box. Typically, to prevent theft of stored items, a tool box includes a hinged door having a locking latch for selectively restricting access to the contents of the tool box. Unauthorized individuals aimed at gaining access to the stored contents of a tool box may attempt to forcefully disengage the lock and pry the tool box open using an instrument, such as a crowbar or hammer, inserted between the edge of the tool box door and the body of the tool box. Generally, the edge of the door nearest the latch is a common target of these attempts. Such attempts may permanently deform both the tool box door and the tool box body, thereby leaving gaps between the door and tool box body, allowing theft of the stored items or permitting rain and debris to enter the enclosure, causing further damage to any remaining items.

A tool box may also be used as a work space for performing tasks, such as hammering, sanding, sawing, cutting or bending, on a work piece. Generally, these tasks involve the repeated application of force to a work piece. Such tasks are commonly performed using the edge of the tool box adjacent to the door to support the work piece. For example, at a construction site a worker may open a tool box door, remove a tool, close the tool box door and then begin hammering or cutting a work piece using the closed toolbox as a work space to support the work piece. Typically, such use takes place on the side of the tool box nearest the door because the user is naturally positioned on that side upon retrieval of a tool from inside the tool box. Further, where the tool box is mounted on a bench or vehicle, the side of the tool box including the door may be the only region accessible for use as a work space. This type of activity may be repeated multiple times, causing tool box doors to experience accelerated wear. Repeated high-impact use can cause injury to the user if the tool box door bends or flexes during such use, causing the work piece to unexpectedly move.

The ability of a tool box to withstand prying and deformation depends greatly on the mechanical strength and rigidity of the door. Others have attempted to produce tool box doors with improved strength by increasing the thickness of the door material. Although thicker material is more resistant to prying and bending, the use of thicker material increases the cost of production and adds weight to the tool box. Prior art tool boxes also include a rectangular sheet metal door bent at the edges to form a rim extending from the door. Conventional tool box doors often flex and deform when used as a work space for high-impact activities. Similarly, a single perpendicular rim does not effectively withstand attempts to pry the door open.

Thus, there is a need for a tool box with a reinforced door having increased rigidity for withstanding prying and resisting flexing during use.

BRIEF SUMMARY

The present invention provides a tool box for storing items. The tool box includes a reinforced door. In one embodiment, the tool box and the reinforced door are made of sheet metal. The door includes a reinforced region extending from at least one edge of the door wherein the reinforced region can include a first flange extending from the door, a second flange extending from the first flange and a third flange extending from the second flange. Additionally, the door includes a first flap extending from an edge of the door adjacent to the reinforced region. The first flap extends in the same direction as the first flange and the first flap can be welded to the reinforced region. Additional flaps or reinforced regions may also extend from the remaining edges of the door.

The reinforced region provides resistance to prying, preventing unauthorized individuals from gaining access to the contents of the tool box. The added strength of the door gives users a greater peace of mind that the stored articles are safe. The reinforced door also provides a safe region of the tool box for use as a work space. The present invention reduces damage resulting from use of the tool box exterior as a work space because the reinforced region provides rigid support to the door, allowing it to withstand greater forces and preventing flexing during use. Similarly, because the reinforced region and the flap provide rigid support to the entire door, the cost of production of the door can be reduced by using thinner material for the door body.

It is therefore a general object of the present invention to provide a tool box having a door with a reinforced edge that is resistant to damage from prying.

Another object of the present invention is to provide a tool box door having a rigid structure that prevents bending during use.

Yet another object of the present invention is to provide a tool box with a reinforced door that can be manufactured at a reduced cost using thinner door material without sacrificing structural rigidity of the door.

Still yet another object of the present invention is to provide a tool box door with a reinforced region that provides a rigid work space for performing tasks on a work piece.

Still yet another object of the present invention is to provide a reinforced tool box door with a reinforced edge that will provide a safe work space for a user.

Still yet another object of the present invention is to provide a tool box having a reinforced door that prevents unauthorized access to the tool box cavity.

Numerous other objects, features and advantages of the present invention will be readily apparent to those skilled in the art upon a reading of the following disclosure when taken in conjunction with the accompanying drawings.

DETAILED DESCRIPTION

Figure 1:
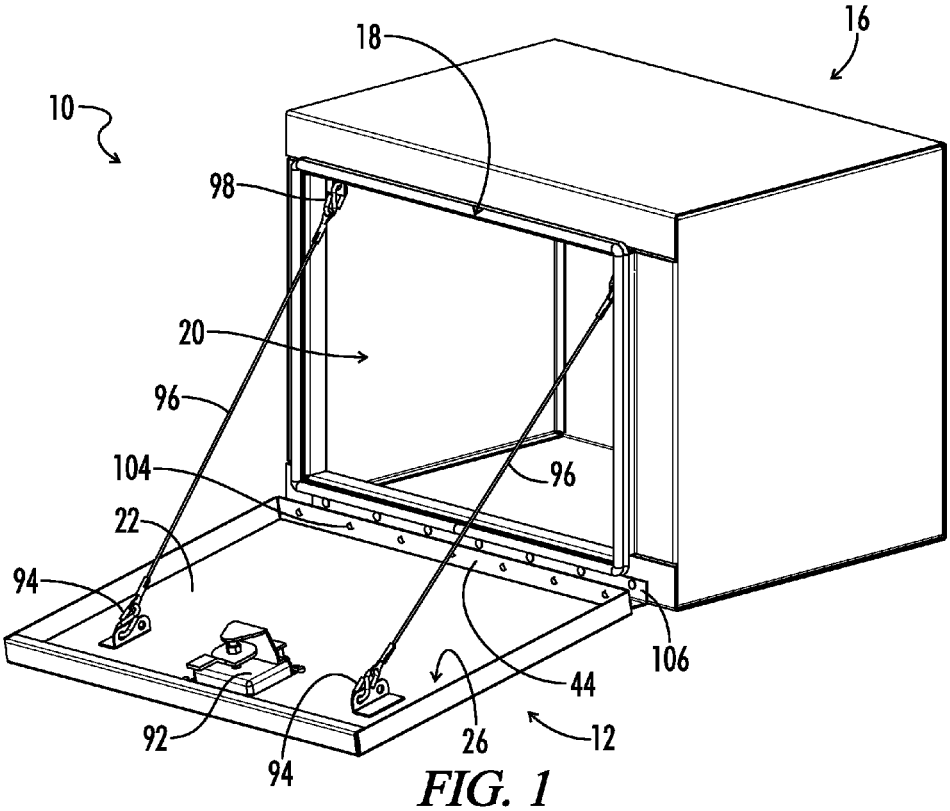
FIG. 1 is a perspective view of an embodiment of a tool box consistent with the present invention.

Referring now to FIG. 1, there is shown generally an embodiment of a tool box 10 consistent with the present invention. The tool box 10 has a box body 16 and a door 12. The box body 16 includes a cavity 20 for storing items and an opening 18 for accessing the cavity 20. The door 12 is connected to the box body 16 by a hinge 106. The door 12 includes mounting holes 104 for connecting the door 12 to the hinge 106. In one embodiment, the mounting holes 104 are positioned on the second flange 44. FIG. 1 illustrates a tool box 10 with the door 12 in an open position. When the door 12 is in the open position, the cavity 20 of the tool box body 16 may be accessed through the opening 18 for retrieving or storing items. To prevent the door 12 from over-swinging on the hinge 106, one embodiment of the tool box 10 may include one or more cables 96 fastened at one end to a first connection point 94 on the tool box door 12 and at the other end to a second connection point 98 on the tool box body 16.

Figure 2:
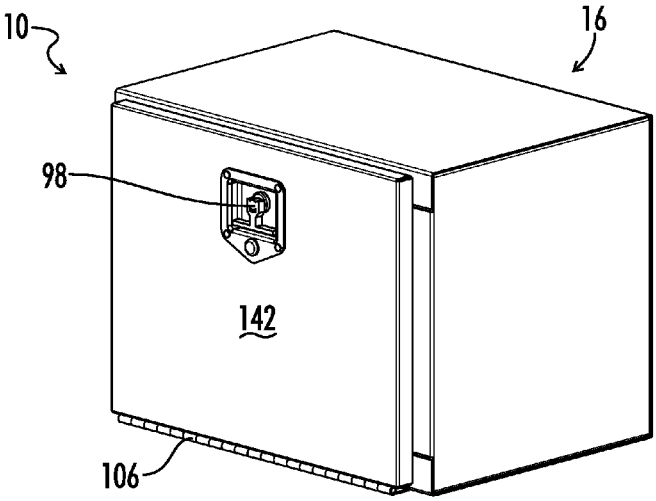
FIG. 2 is a perspective view of an embodiment of a tool box consistent with the present invention.

Referring now to FIG. 2, an embodiment of a tool box 10 is illustrated with the door 12 in a closed position. The door 12 includes a latch 92 for securing the door 12 to the tool box body 16 in the closed position. The latch 92 may also be used to restrict access to the cavity 20 by selectively engaging the tool box body 16 to prevent the door 12 from being opened when the door 12 is in the closed position.

Figure 3:
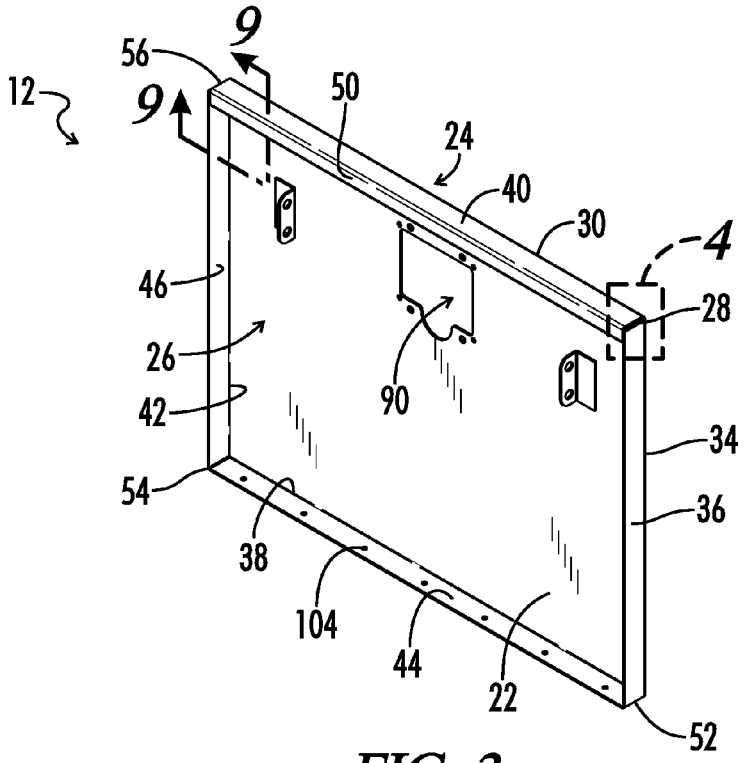
FIG. 3 is a perspective view of a tool box door consistent with the present invention.

As shown in FIG. 3, the door 12 includes a door body 22. The door body 22 includes an interior surface 26. The interior surface 26 of the door body 22 is defined as the surface of the door body 22 facing the cavity 20 when the door 12 is in the closed position. The interior surface 26 of the door body 22 is surrounded by the first edge 30, the second edge 34, the third edge 38 and the fourth edge 42. The door 12 includes at least one reinforced region 24. The reinforced region 24 includes a first flange 40, a second flange 50, and a third flange 60, shown in FIG. 5. The first flange 40 extends from the first edge 30 of the door body 22. In one embodiment, the first flange 40 extends from the door body 22 at an angle about 90-degrees. In one embodiment, the first flange 40 is planar. The first flange 40 extends in the direction of the cavity 20 when the door 12 is in the closed position. The first flange 40 defines a first flange interior surface 100, shown in FIG. 9. The first flange interior surface 100 is defined as the surface of the first flange 40 adjacent to the interior surface 26 of the door body 22. The second flange 50 extends from the first flange interior surface 100. In one embodiment, the second flange 50 extends at an angle about 90-degrees relative to the first flange interior surface 100, and the second flange is planar. The second flange 50 defines a second flange interior surface 104 positioned adjacent to the first flange interior surface 100, shown in FIGS. 8 and 9. The third flange 60 extends from the second flange interior surface 104. The third flange 60 includes a fixed edge 140 connected to the second flange 50. The third flange 60 also includes a free edge 138 extending toward the interior surface 26 of the door body 22. In one embodiment, the third flange 60 is planar. The free edge 138 of the third flange 60 defines a gap 58 between the door body 22 and the third flange 60, shown in FIG. 8.

Referring again to FIG. 3, the door 12 includes a first flap 36 connected to the second edge 34 of the door body 22, a second flap 44 connected to the third edge 38 of the door body 22, and a third flap 46 connected to the fourth edge 42 of the door body 22. In other embodiments, the door 12 may include fewer flaps. Each flap 36, 44, 46 may be welded onto the door body 22, or may alternatively be formed by bending the door body 22.

Figure 4:
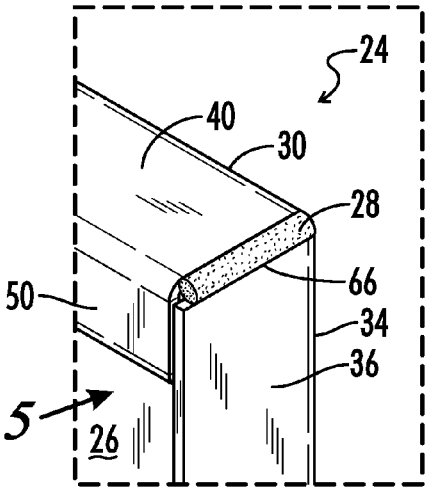
FIG. 4 is a perspective view of a portion of a tool box door consistent with the present invention.
Figure 5:
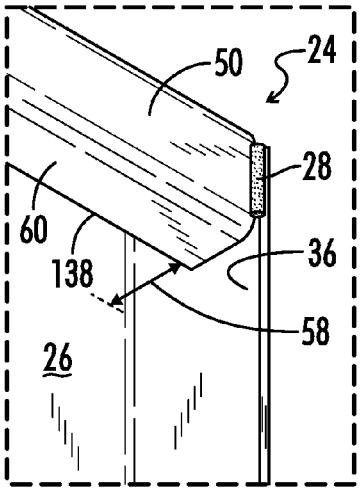
FIG. 5 is a perspective view of a portion of a tool box door consistent with the present invention.

Referring now to FIG. 4 and FIG. 5, a first welded region 28 connects the first flap 36 to the reinforced region 24. In one embodiment, shown in FIG. 4, the first welded region 28 connects the first flap primary edge 66 to the first flange 40. The welded region 28 may also connect the first flap 36 to the second flange 50, as shown in FIG. 5. Alternatively, the welded region 28 may connect the first flap 36 to both the first flange 40 and the second flange 50.

Figure 6:
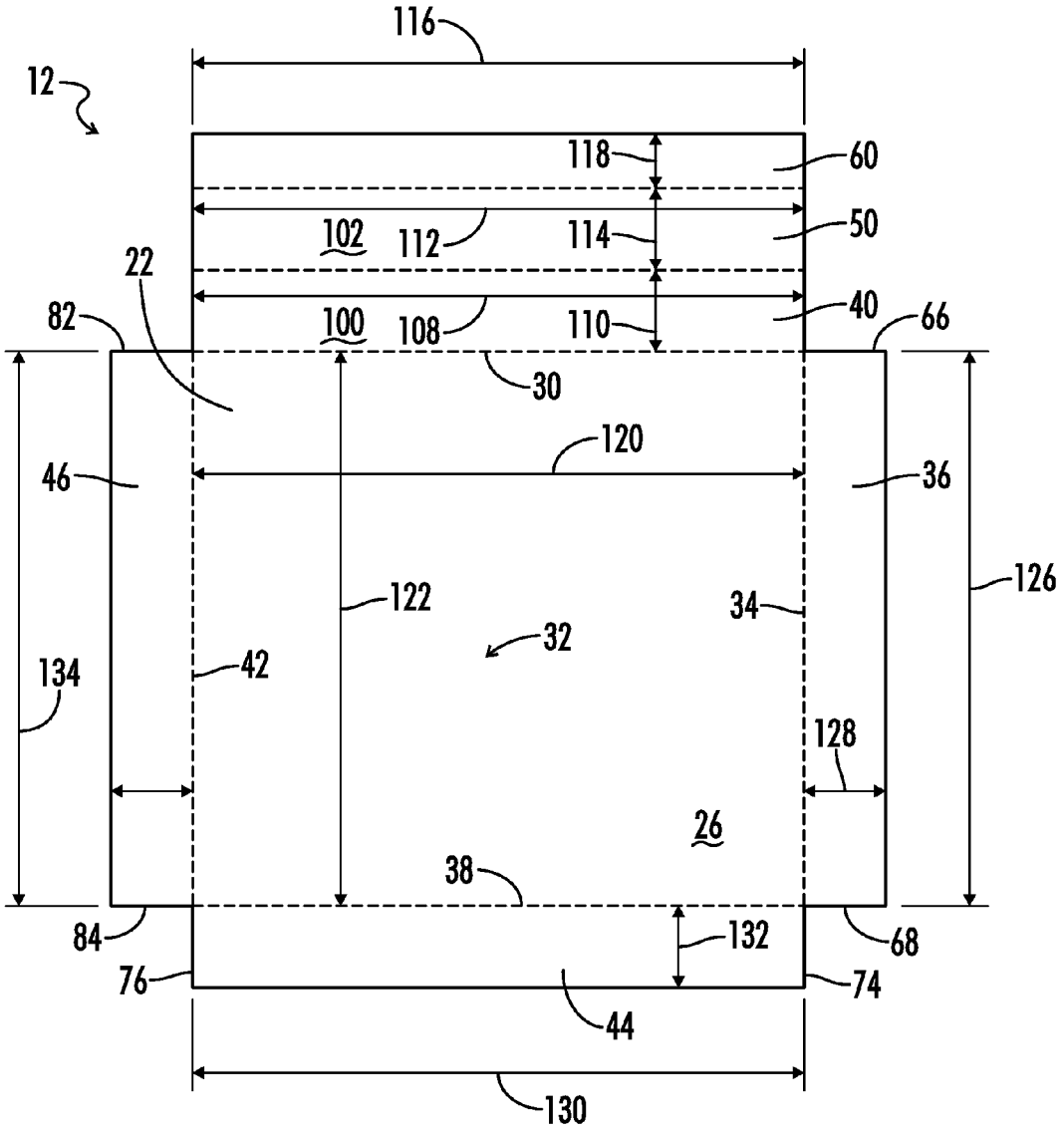
FIG. 6 is a schematic view of a tool box door consistent with the present invention.

Referring now to FIG. 6, one embodiment including a single piece of material for forming into a door 12 consistent with the present invention is shown. Each dotted line corresponds to a region where the door 12 is bent to form a flange or a flap. Referring simultaneously to FIG. 3 and FIG. 6, in one embodiment a second welded region 52 connects the first flap secondary edge 68 to the second flap primary edge 74. The second welded region 52 is positioned to join the first flap secondary edge 68 and the second flap primary edge 74. A third welded region 54, connecting the second flap 44 to the third flap 46, is positioned to join the second flap secondary edge 76 and the third flap secondary edge 84. A fourth welded region 56 connects the third flap primary edge 82 to the reinforced region 24. In one embodiment, the fourth welded region 56 connects the third flap 46 to the first flange 40. In another embodiment the fourth welded region 56 connects the third flap 46 to the second flange 50. In yet another embodiment, the fourth welded region 56 connects the third flap 46 to both the first flap 40 and the second flap 50.

Referring further to FIG. 6, in one embodiment the door 12 is formed from a continuous piece of material, including a door body 22. The door body 22 has a height 122 and a width 120. The door body 22 includes a center point 32 positioned substantially at the center of the interior surface 26 of the door body 22. This embodiment includes a first flange 40 having a width 108 and a length 110. The second flange 50 includes a width 112 and a length 114. The third flange 60 includes a width 116 and a length 118. In one embodiment, the length 118 of the third flange 60 is less than the length 114 of the second flange 50 and less than the length 110 of the first flange 40. In another embodiment, the ratio of the length 118 of the third flange 60 to the length 114 of the second flange 50 is about 0.5. In other embodiments, the ratio may vary from greater than zero to less than one. In one embodiment, the length 114 of the second flange 50 is less than the length 110 of the first flange 40. The width 108 of the first flange 40 is about equal to the width 120 of the door body 22. The width 112 of the second flange 50 is about equal to the width 108 of the first flange 40, and the width 116 of the third flange 60 is about equal to the width 114 of the second flange 50. In other embodiments, the widths and lengths of the first flange 40, second flange 50 and third flange 60 may vary relative to each other or relative to the width 120 and height 122 of the door body 22.

Figure 7:
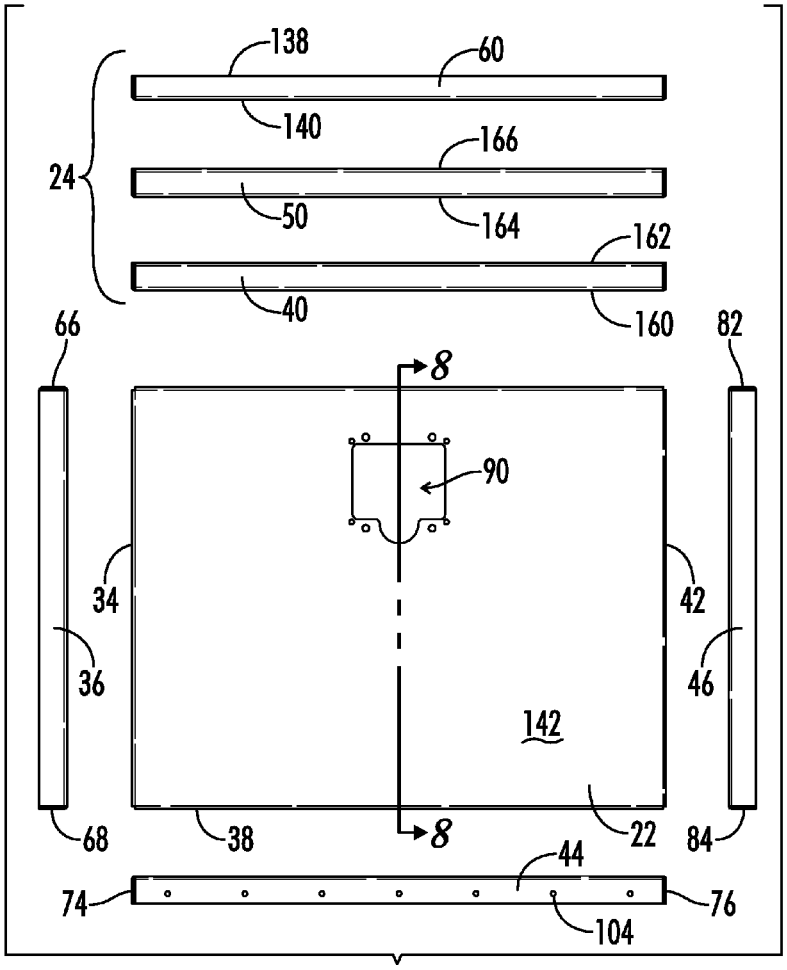
FIG. 7 is an exploded view of a tool box door consistent with the present invention.
Figure 8:
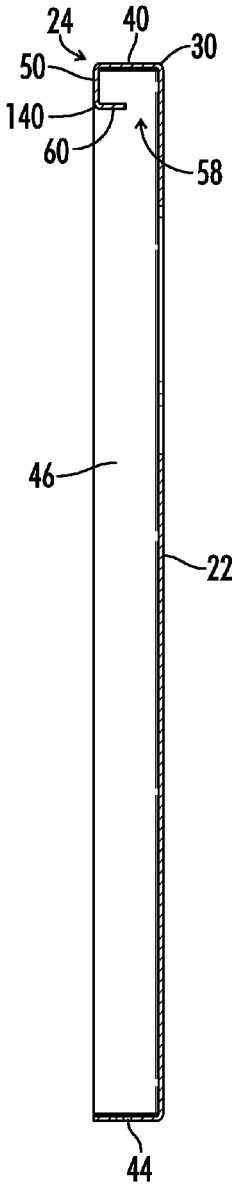
FIG. 8 is a sectional view showing a cross-section of Section A-A of FIG. 7.
Figure 9:
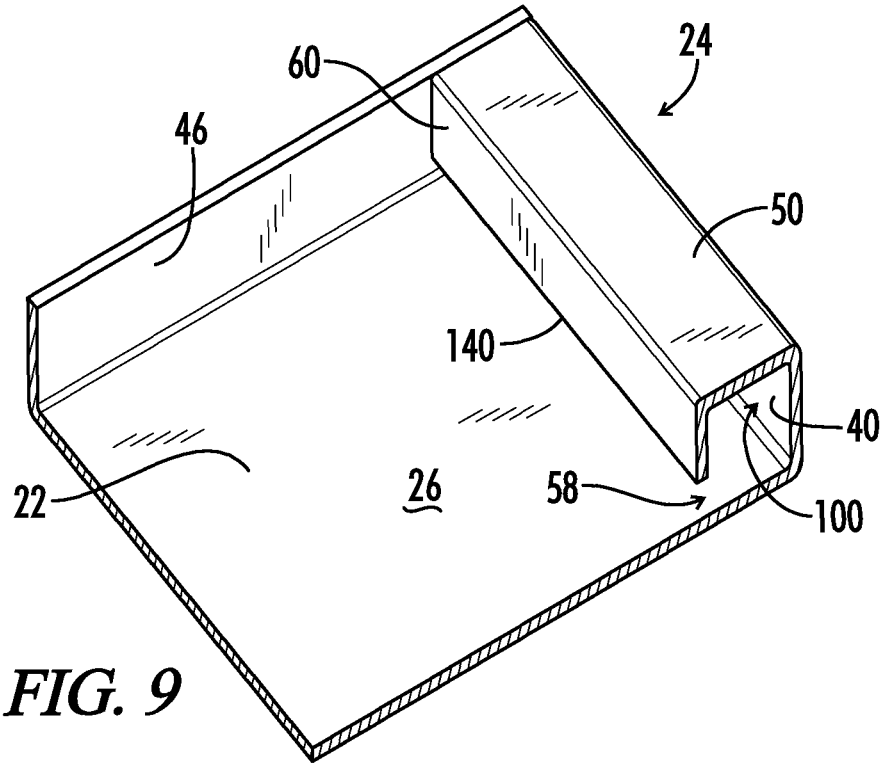
FIG. 9 is a sectional perspective view of an embodiment of a tool box door consistent with the present invention.

Referring now to FIG. 7, one embodiment of a door is illustrated in an exploded view, showing the exterior surface 142 of the door body 22. Consistent with the present invention, the first planar flange 40 includes a proximal edge 160 connected to the first edge 30 of the door body 22, and a distal edge 162. The second planar flange 50 includes a proximal edge 164 connected to the distal edge 162 of the first planar flange 40, and a distal edge 166. The third planar flange 60 includes a fixed edge 140 connected to the distal edge 166 of the second planar flange 50, and a free edge 138. The first flap 36 is connected to the second edge 34 of the door body 22. The second flap 44 is connected to the third edge 38 of the door body 22, and the third flap 46 is connected to the fourth edge 42 of the door body 22. As shown in FIG. 8 and FIG. 9, the free edge 140 of the third flange 60 defines a gap 58 between the third flange 60 and the inner surface 26 of the door body 22.

Figure 10:
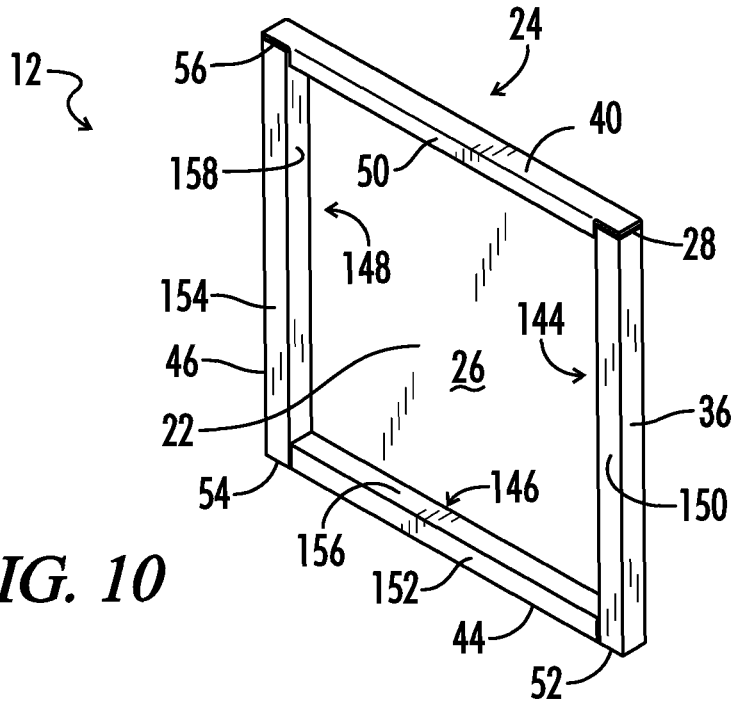
FIG. 10 is a perspective view of one embodiment of a tool box door consistent with the present invention.

Referring now to FIG. 10, further consistent with the present invention, the door 12 may include a second reinforced region 144. The second reinforced region may include a fourth flange 150 extending from the first flap 36. The first welded region 28 connects the first reinforced region 24 to the second reinforced region 144. In another embodiment, a third reinforced region 146 is connected to the second flap 44. The third reinforced region 146 includes a fifth flange 152. The second welded region 52 connects the second reinforced region 144 to the third reinforced region 146. In another embodiment, referring further to FIG. 10, a fourth reinforced region 148 is connected to the third flap 46. The fourth reinforced region 148 includes a sixth flange 154 extending from the third flap 46. The third welded region 54 connects the third reinforced region 146 to the fourth reinforced region 148. The fourth welded region 56 connects the first reinforced region 24 to the fourth reinforced region 148. Other embodiments include a seventh flange 156 connected to the third reinforced region 146 and an eighth flange 158 connected to the fourth reinforced region 148.

Thus, it is seen that the Tool Box with Reinforced Door readily achieves the ends and advantages mentioned as well as those inherent herein. While certain preferred embodiments of the invention have been illustrated and described for the purposes of the present disclosure, numerous changes and arrangement in construction of the parts may be made by those skilled in the art, which changes are accomplished within the scope and spirit of the invention as defined by the appended claims.

What is claimed is:

1. An apparatus for storing items, comprising:

a box body defining a cavity shaped to store the items, the box body including an opening for accessing the cavity;

a door made from a single sheet of material and shaped to cover the opening, the door including a door body, the door body having a first edge, a second edge, a third edge and a fourth edge, the door body having a height and a width defining an interior surface of the door body, the door including a first reinforced region connected to the first edge of the door body;

the first reinforced region comprising:

a first flange connected to the first edge of the door body extending at an angle substantially perpendicular to the interior surface of the door body, the first flange having a length shorter than the height of the door body and including a first flange interior surface positioned adjacent to the interior surface of the door body;

a second flange connected to the first flange extending from the first flange interior surface, the second flange having a length shorter than the height of the door body and including a second flange interior surface positioned adjacent to the first flange interior surface;

a third flange extending from the second flange interior surface, the third flange having a length shorter than the length of the first flange, the third flange having a fixed edge connected to the second flange and a free edge not connected to any other portion of the first reinforced region other than the third flange, the free edge defining a gap between the third flange and the interior surface of the door body;

a first flap extending from the second edge of the door body adjacent to the first edge of the door body in the same direction as the first flange, the first flap having a first flap primary edge and a first flap secondary edge; and a first welded region connecting the first flap primary edge to the first reinforced region of the door body.

2. The apparatus of claim 1, further comprising:

a second flap extending from the third edge of the door body adjacent to the second edge of the door body in the same direction as the first flange at an angle substantially perpendicular to the interior surface of the door body, the second flap having a second flap primary edge and a second flap secondary edge; and a second welded region connecting the first flap secondary edge to the second flap primary edge.

3. The apparatus of claim 2, further comprising:

a third flap extending from the fourth edge of the door body in the same direction as the first flange at an angle substantially perpendicular to the interior surface of the door body, the third flap having a third flap primary edge and a third flap secondary edge;

a third welded region connecting the second flap secondary edge to the third flap secondary edge; and a fourth welded region connecting the third flap primary edge to the first flange.

4. The apparatus of claim 3, wherein the door body, the first flange, the second flange, the third flange, the first flap, the second flap and the third flap comprise sheet metal.

5. The apparatus of claim 1, wherein:

the second flange extends substantially perpendicular to the first flange interior surface; and the length of the second flange is less than the length of the first flange.

6. The apparatus of claim 5, wherein:

the third flange extends substantially perpendicular to the second flange interior surface; and the ratio of the length of the third flange to the length of the first flange is between about 0.3 and 0.7.

7. The apparatus of claim 5, wherein the ratio of the length of the third flange to the length of the second flange is about 0.5.

8. The apparatus of claim 7, the first flange including a width wherein the width of the first flange is substantially equal to the width of the door body.

9. The apparatus of claim 8, wherein:

the second flange including a width wherein the width of the second flange is substantially equal to the width of the first flange; and the third flange including a width wherein the width of the third flange is substantially equal to the width of the first flange.

10. A door apparatus for covering a tool box opening, comprising:

a planar rectangular door body made from a single sheet of material having a first edge, a second edge, a third edge, a fourth edge, and a center point, the first edge positioned opposite the third edge and the second edge positioned opposite the fourth edge, the door body having a height and a width defining a planar interior surface of the door body;

a first planar flange extending from the first edge of the door body generally in the direction of the tool box cavity and substantially perpendicular to the planar interior surface of the door body, the first planar flange having a proximal edge connected to the door body and a distal edge;

a second planar flange extending from the distal edge of the first planar flange generally in the direction toward the center point of the door body, the second planar flange oriented substantially parallel to the interior surface of the door body, the second planar flange having a proximal edge connected to the first flange and a distal edge;

a third planar flange extending from the distal edge of the second planar flange generally in the direction toward the interior surface of the door body, the third planar flange oriented substantially parallel to the first planar flange, the third planar flange having a fixed edge not connected to any other portion of the first reinforced region other than the third flange, the free edge connected to the second planar flange and a free edge defining a gap between the third planar flange and the interior surface of the door body; and a first flap connected to the second edge of the door body, the first flap extending generally in the same direction as the first planar flange, the first flap having a first flap primary edge and a first flap secondary edge, the first flap primary edge being welded to the first planar flange.

11. The apparatus of claim 10, further comprising a second flap extending from the third edge of the door body generally in the same direction as the first planar flange, the second flap having a second flap primary edge and a second flap secondary edge, the second flap primary edge being welded to the first flap secondary edge.

12. The apparatus of claim 11, further comprising a third flap extending from the fourth edge of the door generally in the same direction as the first planar flange, the third flap having a third flap primary edge and a third flap secondary edge, the third flap primary edge being welded to the first planar flange and the third flap secondary edge being welded to the second flap secondary edge.

13. The apparatus of claim 12, wherein the door body, the first planar flange, the second planar flange, the third planar flange, the first flap, the second flap and the third flap comprise sheet metal.

14. A tool box apparatus for storing items, comprising:

a metal box body including a cavity for storing tools, the box body including an opening for accessing the items;

a metal door made from a single sheet of material and having a door body, a first edge, a second edge, a third edge and a fourth edge, the door body having a height and a width defining an interior surface of the door body, the door having an open position and a closed position, the interior surface of the door body facing the cavity of the box body when the door is in the closed position;

a first flange connected to the door body at the first edge and extending from the interior surface of the door body at an angle substantially perpendicular to the interior surface of the door body, the first flange having a length shorter than the height of the door body and including a first flange interior surface positioned adjacent to the interior surface of the door body;

a second flange connected to the first flange extending from the first flange interior surface at an angle substantially perpendicular to the first flange interior surface, the second flange having a length less than the length of the first flange, the second flange defining a second flange interior surface positioned adjacent to the first flange interior surface;

a third flange having a fixed edge connected to the second flange and a free edge, the third flange extending from the second flange interior surface toward the interior surface of the door body at an angle substantially perpendicular to the second flange interior surface, the free edge separated from the first flange, the second flange, and the door body, the free edge of the third flange defining a gap between the interior surface of the door body and the third flange;

a first flap extending from the second edge of the door body and folded toward the interior surface of the door body at an angle substantially perpendicular to the interior surface of the door body, the first flap having a first flap primary edge and a first flap secondary edge;

a first welded region connecting the first flap primary edge to the first flange;

a second flap extending from the third edge of the door body and folded toward the interior surface of the door body at an angle substantially perpendicular to the interior surface of the door body, the second flap having a second flap primary edge and a second flap secondary edge;

a second welded region connecting the second flap primary edge to the first flap secondary edge;

a third flap extending from the fourth edge of the door body and folded toward the interior surface of the door body at an angle substantially perpendicular to the interior surface of the door body, the third flap having a third flap primary edge and a third flap secondary edge;

a third welded region connecting the second flap secondary edge to the third flap secondary edge;

a fourth welded region connecting the third flap primary edge to the first flange;

the door body defining an opening for mounting a latch;

a latch mounted in the opening of the door body, the latch positioned for selectively engaging the box body;

a hinge connected to the door for pivotally securing the door to the box body;

a first cable attachment point positioned on the box body;

a second cable attachment point positioned on the door; and a cable connected to the first cable attachment point and the second cable attachment point.

15. The toolbox apparatus of claim 14, wherein the ratio of the length of the second flange to the length of the third flange is between about 0.5 and 0.8.

16. The toolbox apparatus of claim 14 wherein the ratio of the length of the third flange to the length of the first flange is between about 0.4 and 0.6.

17. The toolbox apparatus of claim 14, further comprising:

the first welded region connecting the first flap to the second planar flange; and the fourth welded region connecting the third flap to the second planar flange.

18. The toolbox apparatus of claim 17, further comprising a fourth planar flange extending substantially perpendicular to the first flap.

19. The toolbox apparatus of claim 18, further comprising a fifth planar flange extending substantially perpendicularly from the second flap.

20. The toolbox apparatus of claim 19, further comprising a sixth planar flange extending substantially perpendicularly from the third flap.

21. An apparatus for storing items, comprising:

a box body defining a cavity shaped to store the items, the box body including an opening for accessing the cavity;

a door made from a single sheet of material and shaped to cover the opening, the door including a door body, the door body having a first edge, a second edge, a third edge and a fourth edge, the door body having a height and a width defining an interior surface of the door body, the door including a first reinforced region connected to the first edge of the door body;

the first reinforced region comprising:

a first flange connected to the first edge of the door body extending at an angle substantially perpendicular to the interior surface of the door body, the first flange having a length shorter than the height of the door body and including a first flange interior surface positioned adjacent to the interior surface of the door body;

a second flange connected to the first flange extending from the first flange interior surface, the second flange having a length shorter than the height of the door body and including a second flange interior surface positioned adjacent to the first flange interior surface;

a third flange extending from the second flange interior surface, the third flange having a length shorter than the length of the first flange, the third flange having a fixed edge connected to the second flange and a free edge defining a gap between the third flange and the interior surface of the door body;

a first flap extending from the second edge of the door body adjacent to the first edge of the door body in the same direction as the first flange, the first flap having a first flap primary edge and a first flap secondary edge; and a first welded region connecting the first flap primary edge to the first reinforced region of the door body.

* * * * *